US007474729B2

(12) United States Patent
Yoon et al.

(10) Patent No.: US 7,474,729 B2
(45) Date of Patent: Jan. 6, 2009

(54) SOFT X-RAY MICROSCOPE

(75) Inventors: Kwon-ha Yoon, Iksan-si (KR); Kyong-woo Kim, Iksan-si (KR)

(73) Assignee: Wonkwang University Center for Industry-Academy Cooperation, Jeollabuk-do (KR)

( * ) Notice: Subject to any disclaimer, the term of this patent is extended or adjusted under 35 U.S.C. 154(b) by 185 days.

(21) Appl. No.: 11/510,615

(22) Filed: Aug. 28, 2006

(65) Prior Publication Data

US 2007/0053487 A1 Mar. 8, 2007

(30) Foreign Application Priority Data

Aug. 30, 2005 (KR) ..... 10-2005-0080109

(51) Int. Cl.
*G21K 7/00* (2006.01)

(52) U.S. Cl. ..... 378/43; 378/34

(58) Field of Classification Search ..... 378/43, 378/34, 35, 84, 85, 57; 250/504 R; 359/368
See application file for complete search history.

(56) References Cited

U.S. PATENT DOCUMENTS 5,912,939 A * 6/1999 Hirsch ..... 378/43
6,545,272 B1 * 4/2003 Kondo ..... 250/305

* cited by examiner

*Primary Examiner*—Hoon Song
(74) *Attorney, Agent, or Firm*—Rabin & Berdo, PC

(57) ABSTRACT

A soft X-ray microscope includes a table (10); a housing (20) installed to the upper side of the table (10) and having a partition (22); a light source chamber (30) installed lower than the partition (22) of the housing (20) to project a light to liquid jetted under a high pressure to generate plasma; a mirror chamber (40), installed above the partition (22) of the housing (20), in which first and second mirror (410 and 430) are respectively installed to upper and lower sides of a holder (420) for storing a living sample, the soft X-ray generated by the plasma generated in the light source chamber (30) illuminates the living sample, and the soft X-ray penetrated the living sample is amplified to obtain an image in an image capturing chamber; and an image capturing chamber (50) installed to the upper side of the housing (20) to amplify a light image signal amplified through the mirror chamber (40) and to capture the light image on an external screen to allow distinguishing the light image from exterior.

19 Claims, 10 Drawing Sheets

SOFT X-RAY MICROSCOPE

BACKGROUND OF THE INVENTION

1. Field of the Invention

The present invention relates to a soft X-ray microscope, and more particularly, to a soft X-ray microscope that uses a liquid target that is not affected by target fragments and that has excellent monochromaticity so that the soft X-ray microscope can be easily used in a laboratory and has spatial resolution of no more than 100 nm.

2. Description of the Related Art

In general, a microscope refers to an apparatus for enlarging a minute part of an object (hereinafter, referred to as a sample) to observe the minute part and may include an electronic microscope that uses electrons as a light source or an optical microscope that uses visible rays as a light source.

In the case of the electronic microscope, since the sample must be put under vacuum and must be physically and chemically pre-processed, it is not possible to observe a living sample such as the cells of an organism. In the case of the optical microscope, it is possible to observe a living sample; however, since the visible rays are used as the light source, the resolution is limited to about 200 nm due to the diffraction limitation of the light source according to the current technology.

Recently, a soft X-ray microscope using an X-ray wavelength region referred to as window of water ($\lambda$=2.3 to 4.4 nm) has been studied. In the region of the window of water, since there exists large X-ray absorption differences between water and protein that constitutes the living sample, it is possible to observe protein through a water layer of a thickness of several microns and to observe the inside of the living sample due to the permeability of X-ray.

The above-described soft X-ray microscope includes a light source chamber in which a solid target made of tantalum is provided, a light source for focusing pulse light on the solid target to generate X-ray so that the X-ray is radiated onto the living sample, a sample chamber in which the living sample is provided, a mirror chamber for leading the X-ray that transmits the sample to capturing device, and the capturing device for capturing the X-ray image that is scattered by the living sample or that transmits the living sample.

The operation of the soft X-ray microscope having the above structure will be described as follows. When the pulse light is emitted from the light source to the solid target, the pulse light collides with the target to generate a predetermined X-ray. The generated X-ray is radiated onto the living sample provided in the sample chamber to be scattered by the living sample and to transmit the image of the living sample. The capturing device captures the light that is scattered by the living sample and that transmits the image of the living sample so that the living sample can be observed.

However, since the target onto which the pulse light is radiated is solid, minute pieces are generated in the part onto which the pulse light is radiated and the generated pieces are attached to the internal surface of the light source chamber that remains vacuous in which the solid target is provided so that the vacuum degree is damaged. In particular, the pieces attached to the internal surface of the light source chamber prevent the X-ray from being precisely generated so that it is difficult to repeatedly use the soft X-ray microscope for a long time.

Furthermore, the solid target damaged by the radiation of the pulse light must be frequently exchanged in order to precisely generate the X-ray so that the light source chamber in which the solid target is provided must be released and reset under vacuum. Therefore, work time and maintenance and repair expenses increase.

The mirror chamber that leads the X-ray generated by the light source chamber to pass through the living sample includes mirrors on both sides of the living sample, that is, an illuminating mirror for illuminating the living sample before the pulse light passes through the living sample and an amplifying mirror for enlarging and amplifying the light that passed through the living sample illuminated by the illuminating mirror by the capturing device. The X-ray generated by the light source chamber is illuminated and enlarged by the mirrors and passes through the living sample and the capturing device captures the X-ray image to obtain an image.

However, in the above case, in order to enlarge and photograph the light that passed through the living sample by the capturing device in accordance with the optical enlargement magnification formula, the distance between the sample chamber and the capturing device is 3 to 4 m on the average, the magnification is about 286, and resolution is about 200 nm, which is similar to the resolution of the optical microscope.

As described above, the soft X-ray microscope in which the distance between the sample chamber and the capturing device is 3 to 4 m on the average in order to obtain an image of high magnification as mentioned above is preferably horizontally installed rather than vertically installed so that the use area of the soft X-ray microscope increases and that the space efficiency of a work place deteriorates.

Therefore, a work place for the exclusive use of the soft X-ray microscope must be additionally provided, which causes inconvenience and inefficiency.

SUMMARY OF THE INVENTION

In order to solve the above problem, it is an object of the present invention to provide a soft X-ray microscope in which a liquid target with no target pieces and having excellent monochromaticity ($\lambda/\Delta\lambda$), that is, liquefied nitrogen is used so that the soft X-ray microscope has spatial resolution of no more than 100 nm and can be continuously used for a long time.

It is another object of the present invention to provide a soft X-ray microscope that includes a mirror chamber made of a dual oval illuminating mirror and a Fresnel diffraction zone plate such that the living sample is illuminated by the illuminating mirror and the light penetrated the living sample is amplified and obtained by the Fresnel diffraction zone plate so that the resolution of no more than 100 nm and an expanded image more than 1000× magnification are provided, the distance from the mirror chamber to the image capturing device is minimized, and the microscope can be minimized.

It is still another object of the present invention to provide a soft X-ray microscope in which the respective devices are vertically provided to minimize the installation space thereof so that it is possible to maximize the space efficiency, to increase the application range of the soft X-ray microscope, and to conveniently install the soft X-ray microscope.

In order to achieve the above objects, there is provided a soft X-ray microscope including: a table; a housing installed to the upper side of the table and having a partition; a light source chamber installed lower than the partition of the housing to project a light to liquid jetted under a high pressure to generate plasma; a mirror chamber, installed above the partition of the housing, in which first and second mirror are respectively installed to upper and lower sides of a holder for storing a living sample, the soft X-ray generated by the plasma generated in the light source chamber illuminates the living sample, and the soft X-ray penetrated the living sample is amplified to obtain an image in an image capturing chamber; and an image capturing chamber installed to the upper side of the housing to amplify a light image signal amplified through the mirror chamber and to capture the light image on an external screen to allow distinguishing the light image from exterior.

Preferably, the soft X-ray microscope further includes a telemicroscope installed to the side of the light source chamber to allow watching the procedure of projecting the soft X-ray to the high-pressure liquid to form the plasma from the exterior.

The light source chamber includes a nozzle part for jetting liquid nitrogen supplied from the exterior under a high pressure, a discharge part provided opposite to the nozzle part to suction the liquid nitrogen and to discharge the liquid nitrogen to the exterior; a light source for projecting a light to the liquid nitrogen jetted from the nozzle part to form the plasma; and a light source vacuum pump for vacuuming the inside of the housing in which the light source is installed and for maintaining vacuum of the housing.

The nozzle part includes a capillary tube for receiving the high-pressure nitrogen gas from the exterior to jet the high-pressure nitrogen gas, and an outer tube for surrounding the outer circumference of the capillary tube and for receiving the high-pressure liquid nitrogen from the exterior to be filled up and to liquefy the high-pressure nitrogen gas jet through the capillary tube.

Preferably, the light source includes a diode pump solid laser having an average power of 12 W and a repetition rate of 300 Hz.

Preferably, the light source vacuum pump includes a turbo molecular pump having a vacuum degree of more than 500 L/S.

The mirror chamber includes: a first base plate fixed to the upper side of the partition of the housing and having a first transmission hole formed in the central portion thereof; a first mirror including a first transporting device installed on the first base plate, and a condenser mirror installed in the central portion of the first transporting device to amplify the light and to illuminate the living sample; a second base plate positioned above the first mirror, supported by a plurality of supporting rods to maintain the distance from the first base plate, and having a second transmission hole formed in the central portion thereof; a holder part including a second transporting device installed on the second base plate, and a coupling for separating and coupling the holder storing the living sample from and to the central portion of the second transporting device; a second mirror including a third transporting device installed on the second base plate, and a Fresnel diffraction zone plate installed in the central portion of the third transporting device and positioned above the holder; and a vacuuming device for vacuuming the inside of the housing having the mirror chamber and for maintaining vacuum.

The soft X-ray microscope further includes a rod lock chamber provided at the side of the mirror chamber and to transport the holder such that vacuum of the mirror chamber is not damaged and the holder storing the living sample is coupled with and separated from the coupling of the holder part.

The soft X-ray microscope further includes an optical aligning device for checking whether the first mirror, the holder part, and the second mirror are aligned in the optical axis direction, and for aligning the same.

Preferably, the condenser mirror includes first and second oval-shaped hedrons symmetrical to each other and having an optical axis-directional length 136 mm, an inner diameter of 50 mm, and a depth of 42 mm, and a pin hole formed in the center portion in the longitudinal direction, and the first and second oval-shaped hedrons are formed by ovals having a longitudinal directional center as a focal point, a distance of 160 mm from the focal point to another focal points, and symmetrical to each other with respect to the central focal point.

The holder part includes: a holder including a sample part having sample windows made of a silicon nitride layer ($Si_3N_4$) with a thickness of 90 nm to 120 nm to cover ends of the living sample and viton plates for covering ends of the sample windows, a sample plate, on which the sample part is placed, having a transmission hole formed in the center and a locking hook formed in a side, a cover plate for covering the upper side of the sample plate on which the sample part is placed and having a transmission hole formed in the center thereof, and an O-ring for maintaining sealing between the sample plate and the cover plate; a coupling including a plurality of supporting plates having a plurality of ball plungers to support outer circumference of the sample plate, and an opened portion enabling the holder to separate; and a second transporting device provided at the side of the coupling and transported in the three directions of the X-axis, the Y-axis, and the Z-axis by a motor.

The Fresnel diffraction zone plate is manufactured by forming gold (Au) having a thickness of 100 nm to 160 nm on a silicon nitride layer ($Si_3N_4$) substrate, and has an outmost zone width of 30 mm to 40 mm a diameter of 60 mm to 70 mm, and the number of Fresnel diffraction zone plate is 200 to 300.

The vacuuming device includes at least one turbo molecular pump of 210 L/S and at least one ion pump of 120 L/S.

The rod lock chamber includes a vacuuming device for preventing vacuum generated in the mirror chamber from being damaged when the holder storing the living sample is separated from and coupled with the mirror chamber, wherein the vacuuming device includes a turbo molecular pump of 60 L/S and an ion pump of 30 L/S.

The soft X-ray microscope further includes a filter installed in the lower side of the first base plate to filter the light transmitted to the mirror chamber through the plasma generated by the light source chamber and to separate the vacuum of the light source chamber and the mirror chamber, and made of titanium.

The soft X-ray microscope further includes a shielding device installed to the lower side of the second base plate to interrupt a direct light, which is not amplified by the condenser mirror, to directly illuminate the living sample when illuminating the illuminated through the condenser mirror, and including a through-hole formed in a supporting plate supported by a fourth transporting device, and a focal point interrupting plate installed in the center of the through-hole to interrupt the direct light.

The image capturing chamber includes a multi-channel plate for converting a light image signal obtained through the light amplified by the second mirror into an electric signal, and a CCD for amplifying the electric signal converted by the multi-channel plate and for converting the amplified electric signal into a visible light using a fluorophor such that the converted visible light forms an image on the external screen through an optical lens.

BRIEF DESCRIPTION OF THE DRAWINGS

The invention will be described in detail with reference to the following drawings in which like reference numerals refer to like elements, and wherein.

DETAILED DESCRIPTION OF THE PREFERRED EMBODIMENTS

Hereinafter, the present invention will be described in detail with reference to the attached drawings.

A soft X-ray microscope includes a light source chamber for generating a soft X-ray wavelength area using light projected from a light source, a mirror chamber provided to a side of the light source chamber to illuminate an living sample using the soft X-ray generated by the light source chamber and to expand the light illuminated to the living sample such that an image capturing chamber captures an image, and the image capturing chamber provided to a side of the mirror chamber to convert the image capture in the mirror chamber such that an external device can discern the converted image, wherein the light source chamber, the mirror chamber, and the image capturing chamber are controlled an integrated operating program and an optical aligning algorithm.

Figure 1:
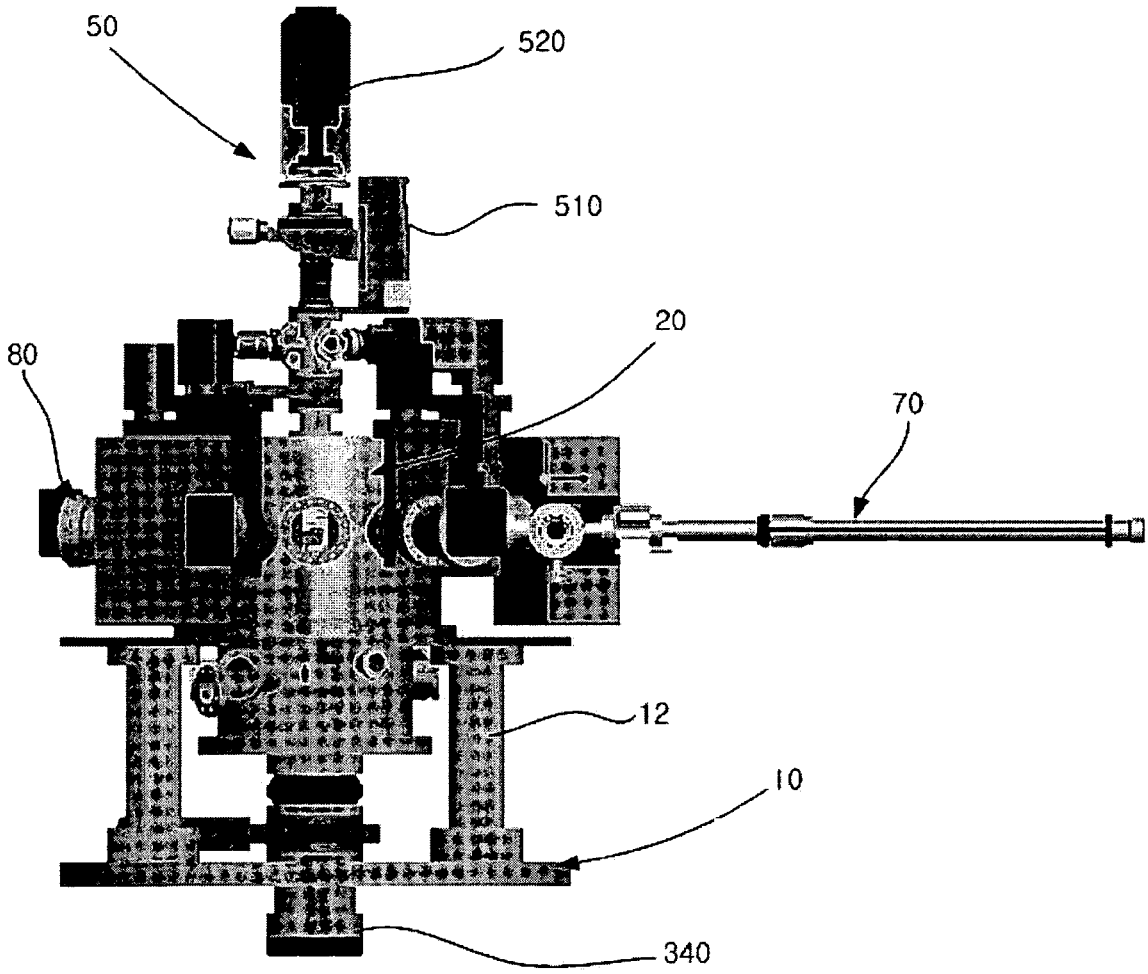
FIG. 1 schematically illustrates the external appearance of a soft X-ray microscope according to the present invention.
Figure 2:
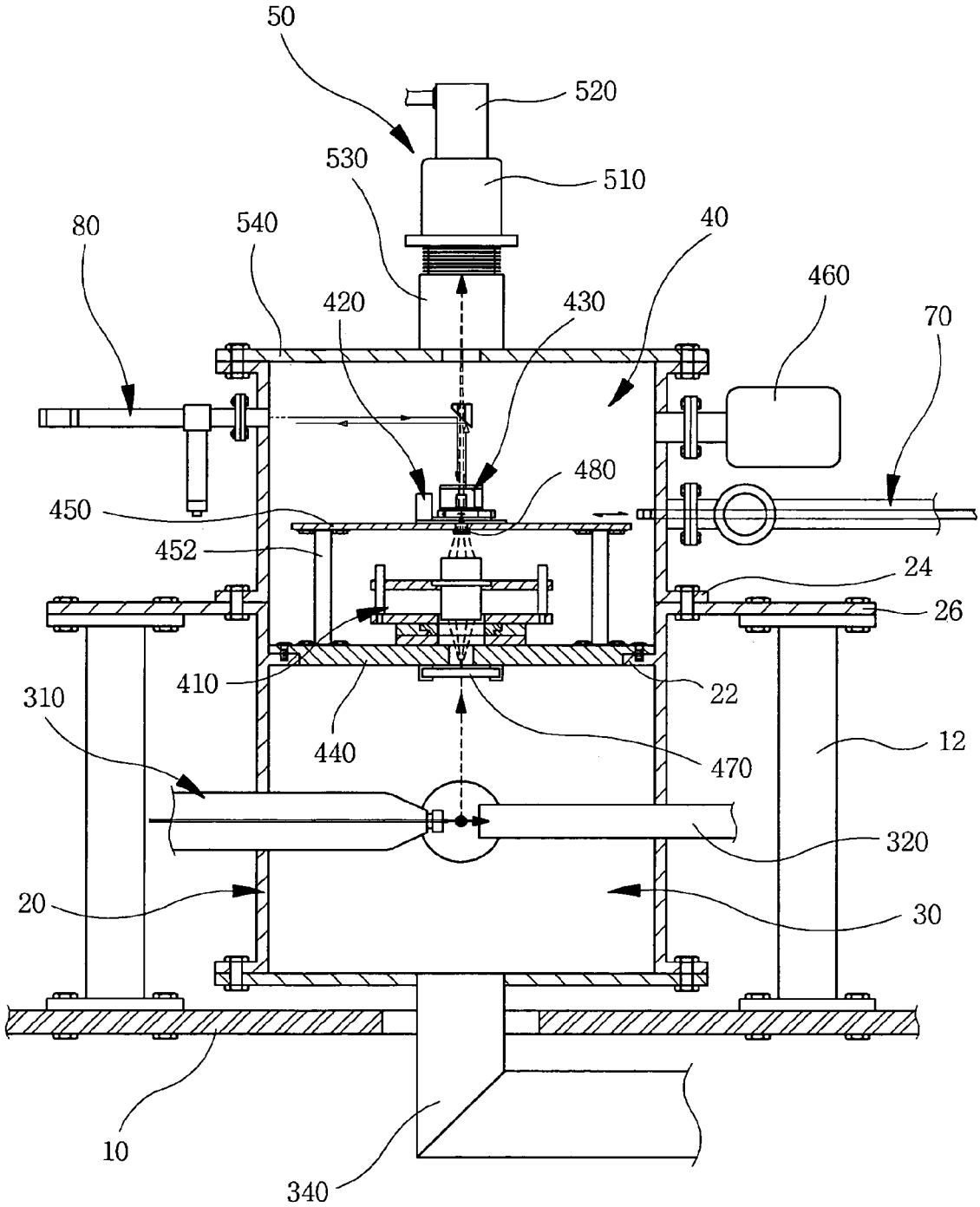
FIG. 2 is a sectional view of the soft X-ray microscope according to the present invention.

FIG. 1 schematically illustrates the external appearance of a soft X-ray microscope according to the present invention, and FIG. 2 is a sectional view of the soft X-ray microscope according to the present invention. Referring to the drawings, the soft X-ray microscope includes a table 10, a housing 20 installed in the table 10, a light source chamber 30 installed in the lower side of the housing 20, a mirror chamber 40 installed above the light source chamber 30, and an image capturing chamber 50 installed at the upper side of the housing 20.

The soft X-ray microscope is installed in the vertical direction so that radius of the soft X-ray microscope is optimized and the efficiency of the space for installation is maximized.

The table 10 can use any device that is not affected by external vibrations, and preferably is implemented by a cradle type optical table.

The housing 20 is a hollow cylinder and includes a partition installed at a predetermined depth thereof.

Moreover, the housing, as shown in the drawings, includes a ring-shaped locking step 24 provided at a predetermined height of the outer circumference of the housing 20, a blade 26 fixed to the ring-shaped locking step 24, and is structured such that a plurality of interval maintaining devices 12 is fixed to the lower side of the blade 26 so that the table 10 and the housing 20 are spaced apart from each other by the interval maintaining devices 12. This is to minimize the affects due to vibrations in spite of installing the housing 20 on the table 10.

The light source chamber 30 is installed below the partition 22 of the housing 20. Since the partition 22 of the housing 20 is closed by a first base plate 440 of the mirror chamber 40 and the lower side of the housing 20 is closed by a light source vacuum pump 340, the interior of the housing 20 in which the light source chamber 30 is installed can be maintained in a vacuum.

Figure 3:
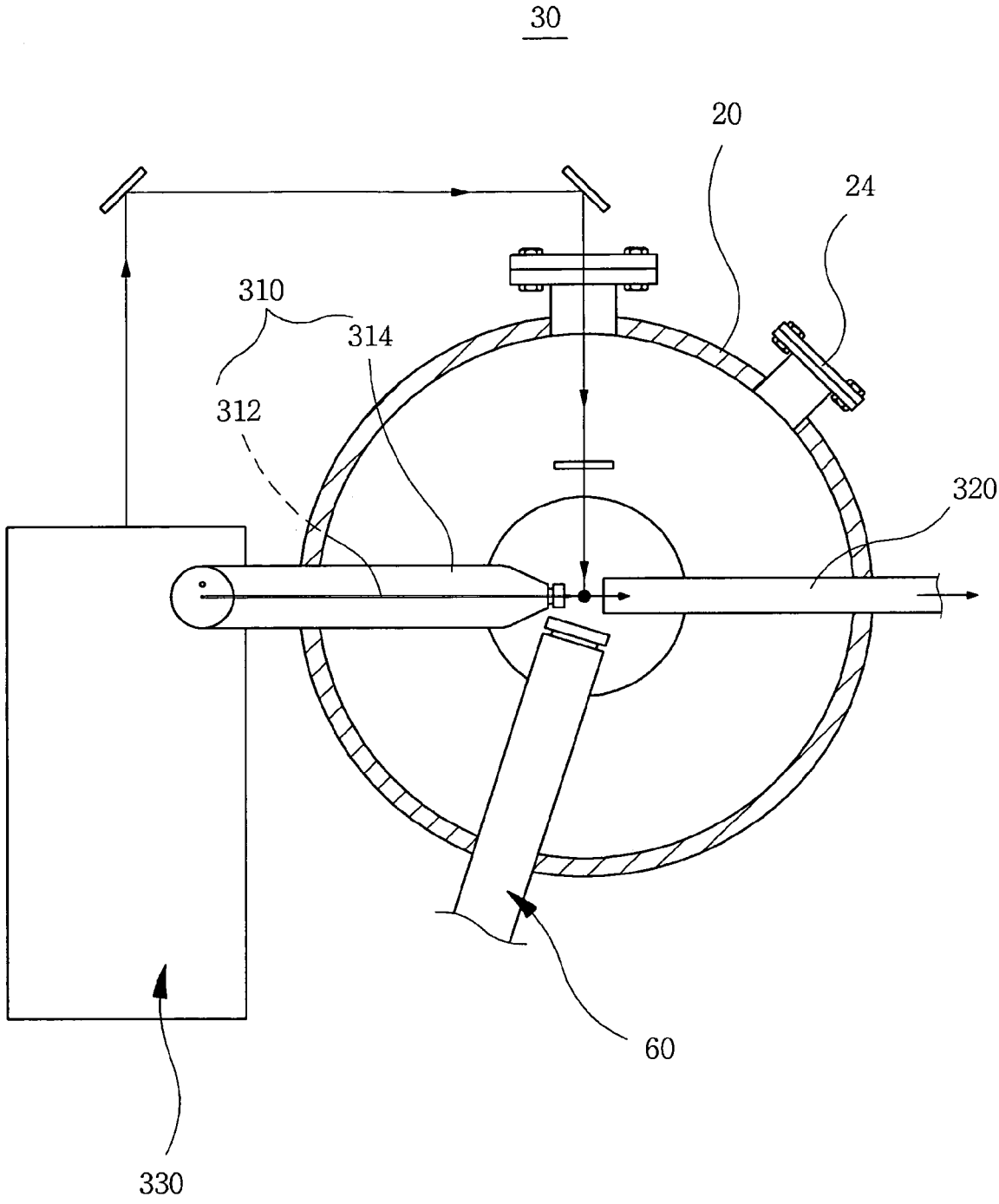
FIG. 3 is a plan view of a light source chamber of the soft X-ray microscope according the present invention.

FIG. 3 is a plan view of the light source chamber. Referring to the drawing, the light source chamber 30 includes a discharge part 320 aligned with a nozzle part 310 provided at a side of the light source chamber 30, a light source 330 installed between the nozzle part 310 and the discharge part 320 to project light, and a tele-microscope 60 for allowing a user to check an operation state of the nozzle part 310, the discharge part 320, and the light source 330.

The nozzle part 310 is a device for jetting high-pressure liquid to form a liquid target, and preferably includes a capillary tube 312 for jetting nitrogen gas supplied from an exterior to the housing and an outer tube 314 for surrounding the capillary tube 312 and for receiving high-pressure liquid nitrogen from an exterior to liquefy the nitrogen gas jetted through the capillary tube 312. Of course, according to circumstances, only liquid nitrogen may be used.

Moreover, the light source 330 preferably utilizes a high power laser such as a diode pump solid laser of average 12 W and a repetition rate of 300 Hz.

In other words, the liquid nitrogen jetted through the capillary tub 312 of the nozzle part 310 becomes the liquid target serving as a medium and the laser beam projected from the light source 330 is projected to the liquid target so that plasma of the soft X-ray laser having a wavelength of 2.3 nm to 4.4 nm is generated.

Meanwhile, the inside of the housing 20 can be vacuumed or the vacuum state of the housing 20 can be maintained by the light source vacuum pump 340 for closing the lower side of the housing 20. In this case, the light source vacuum pump 340 is preferably implemented by a turbo molecular pump having a vacuuming capacity of more than 500 L/S.

In addition, the housing 20 includes at least one window 24 to enable a user to check the inside of the housing 20.

Figure 4:
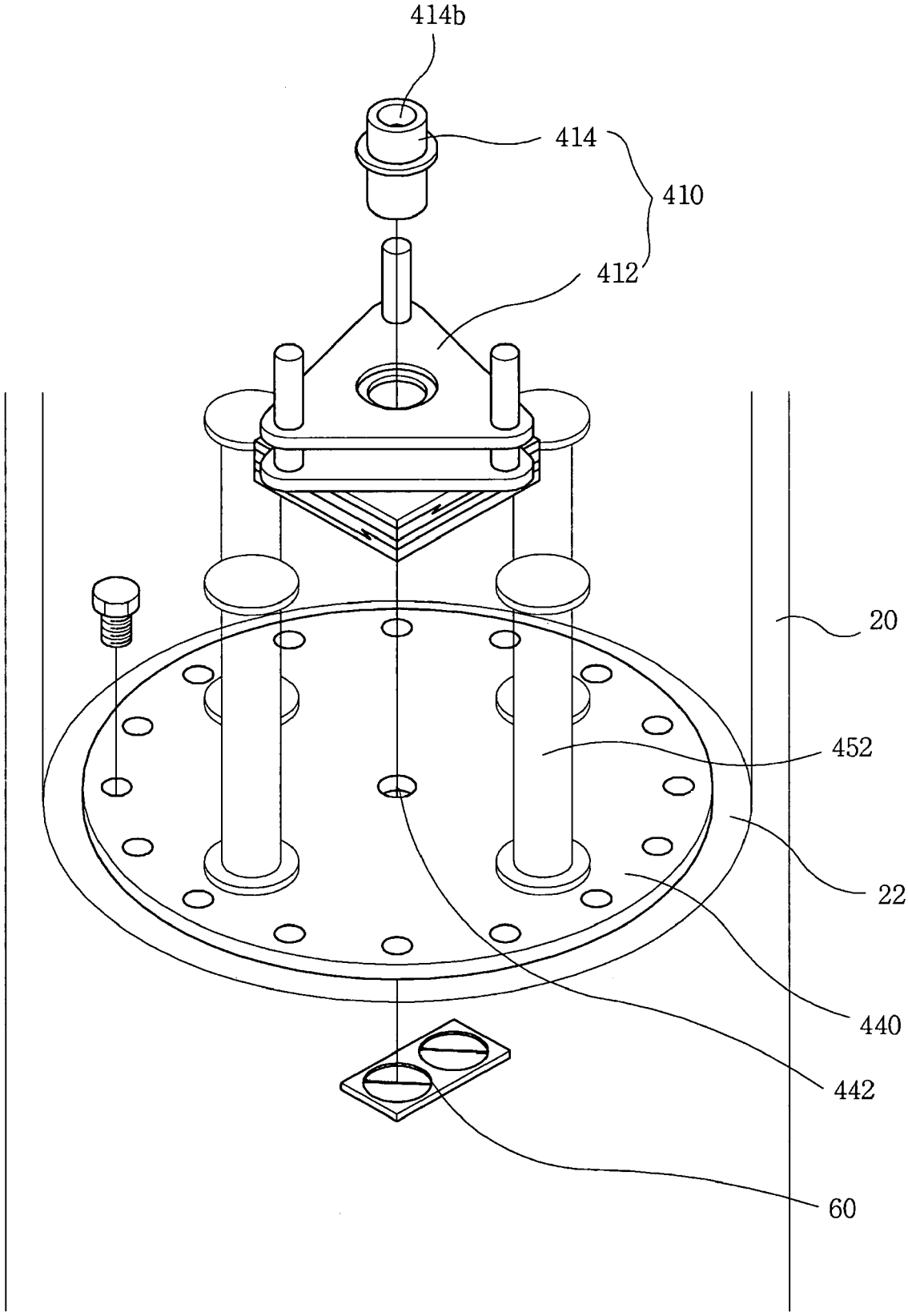
FIG. 4 is an exploded perspective view of a first base plate and a first mirror according to the present invention.
Figure 5:
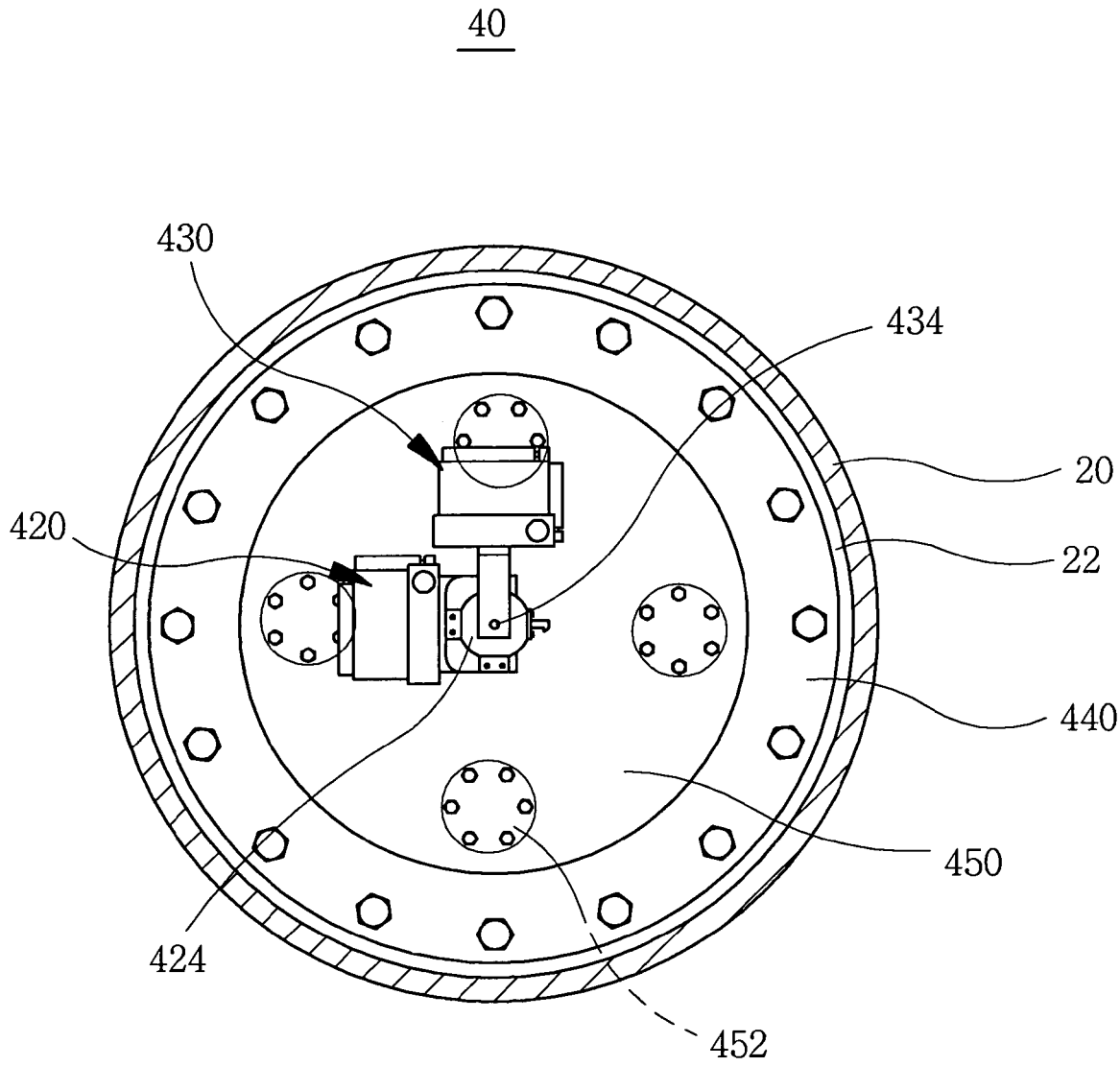
FIG. 5 is a plan sectional view of a mirror chamber provided in a housing according to the present invention.

FIG. 4 is an exploded perspective view of a first base plate and a first mirror according to the present invention, and FIG. 5 is a plan sectional view of a mirror chamber provided in a housing according to the present invention. The mirror chamber 40 is installed above the partition 22 of the housing 20, and includes a first base plate 440 fixed to the upper side of the partition 22, a first mirror 410 installed on the upper side of the first base plate 440, a second base plate 450 positioned above the first mirror 410, a holder part 420 installed on the second base plate 450, and a second mirror 430 positioned above the holder part 420.

The first base plate 440 is fixed to the upper side of the partition 22 of the housing 20 by a plurality of fastening devices, has a first transmission hole 442 formed in the central portion thereof such that the soft X-ray passes through the first transmission hole 442 according to the generation of plasma in the light source chamber 30, and a filter 470 installed in the lower side of the first transmission hole 442, that is, in the lower side of the first base plate 440 so that wavelength of the soft X-ray is filtered through the filter 470 and vacuum of the light source chamber 30 and the mirror chamber 40 are separated from each other.

Additionally, the filter 470 is made of titanium and preferably has a thickness of about 100 nm to 200 nm. Particularly, the filter 470 is made to be exchanged.

The first mirror includes a first transporting device 412 installed on the first base plate 440 and a condenser mirror 414 installed to the first transporting device 412 and that can have its position adjusted.

Additionally, the position of the first transporting device 412 is adjusted in multiple directions of the X-axis direction, the Y-axis direction, and the Z-axis direction, and preferably includes separate motors installed in the respective axes to move along the respective axes.

Figure 6:
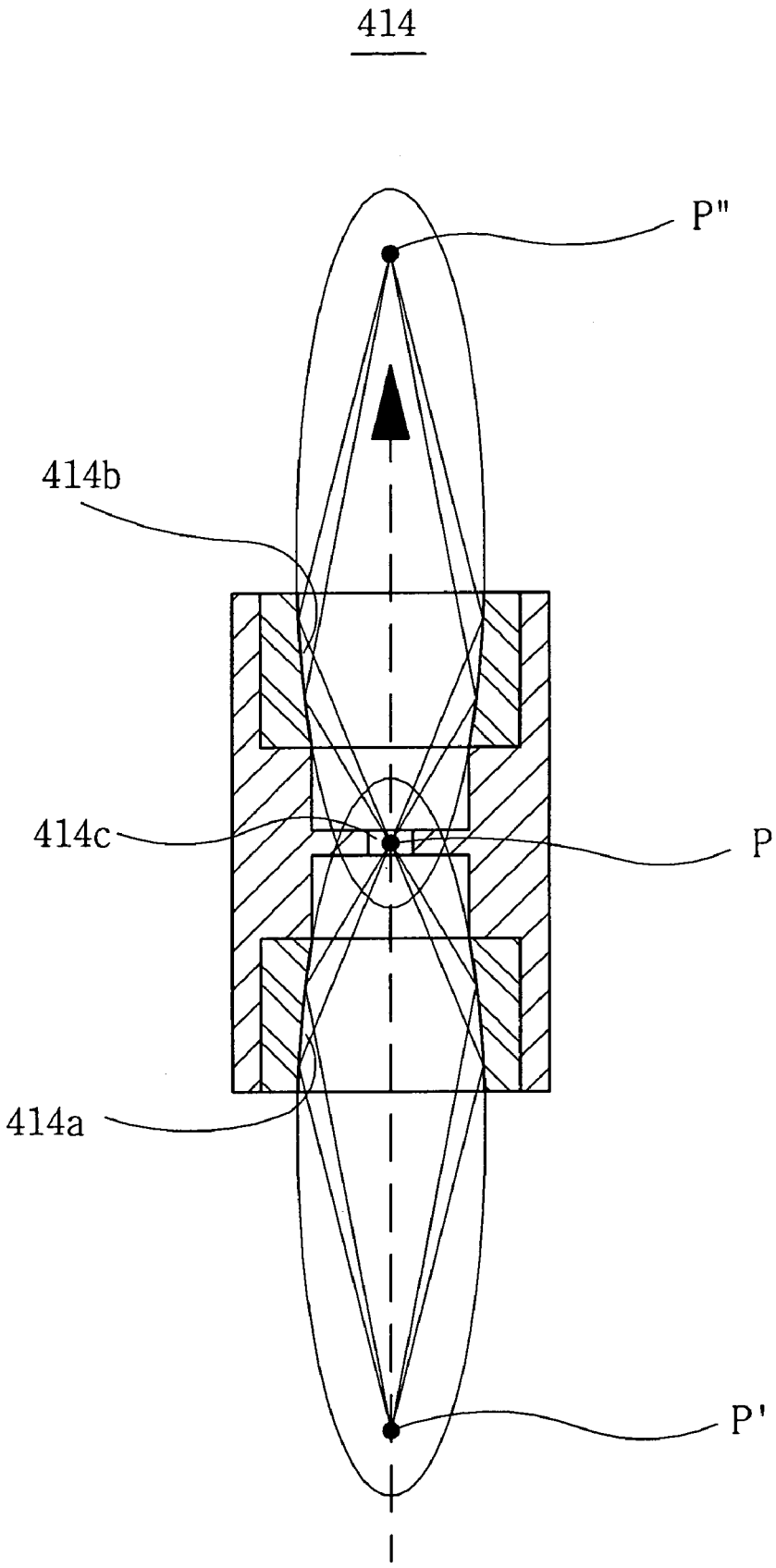
FIG. 6 is an enlarged sectional view of a condenser mirror according to the present invention.

FIG. 6 is an enlarged sectional view of the condenser mirror. As shown in the drawing, the condenser mirror 414 is an illuminating mirror for amplifying a wavelength of the soft X-ray obtained through the plasma generated in the light source chamber 30 and for illuminating the living sample with the amplified soft X-ray. The condenser mirror 414 amplifies the wavelength of the soft X-ray to illuminate the living sample using symmetric oval-shaped hedron.

Additionally, the condenser mirror 414 includes first and second oval-shaped hedrons 414*a* and 414*b* symmetrical to each other and having an optical axis-directional length 136 mm, an inner diameter of 50 mm, and a depth of 42 mm, and a pin hole 414 formed in the center portion in the longitudinal direction.

Moreover, the first and second oval-shaped hedrons 414*a* and 414*b* are preferably formed by ovals having a longitudinal directional center as a focal point P, a distance of 160 mm from the focal point P to another focal points P' and P", and symmetrical to each other with respect to the central focal point P.

Referring to FIG. 6, in view of the principle that the length of a line started from a focal point and terminated to another focal point after reflected by the oval is identical, as shown in the drawing, it can be learned that all lines passing through two focal points P-P' or P-P" are identical.

Preferably, in the condenser mirror 414 using the principle, one focal point P' is positioned in the first transmission hole 442 of the first base plate 440 and the opposite another focal point P" is positioned on the living sample.

By doing so, the soft X-ray passing through the first transmission hole 442 passes through one focal point P', is reflected by the first oval-shaped hedron 414*a*, passes through the central focal point P, and is collected to another focal point P" after reflected by the second oval-shaped hedron 414*b*, so that the soft X-ray illuminates the living sample placed on the focal point P".

Additionally, the wavelength of the soft X-ray is reflected by the first and second oval-shaped hedrons 414*a* and 414*b* and is amplified. The wavelength of the soft X-ray that is not reflected by one focal point P' or the first and second oval-shaped hedrons 414*a* and 414*b* is interrupted by the pin hole 414*c* formed in the center of the condenser mirror 414.

Moreover, a direct light passing through the pin hole 414*c* is interrupted by a shielding device 480, described later, installed in the lower side of the second base plate 450.

Figure 7:
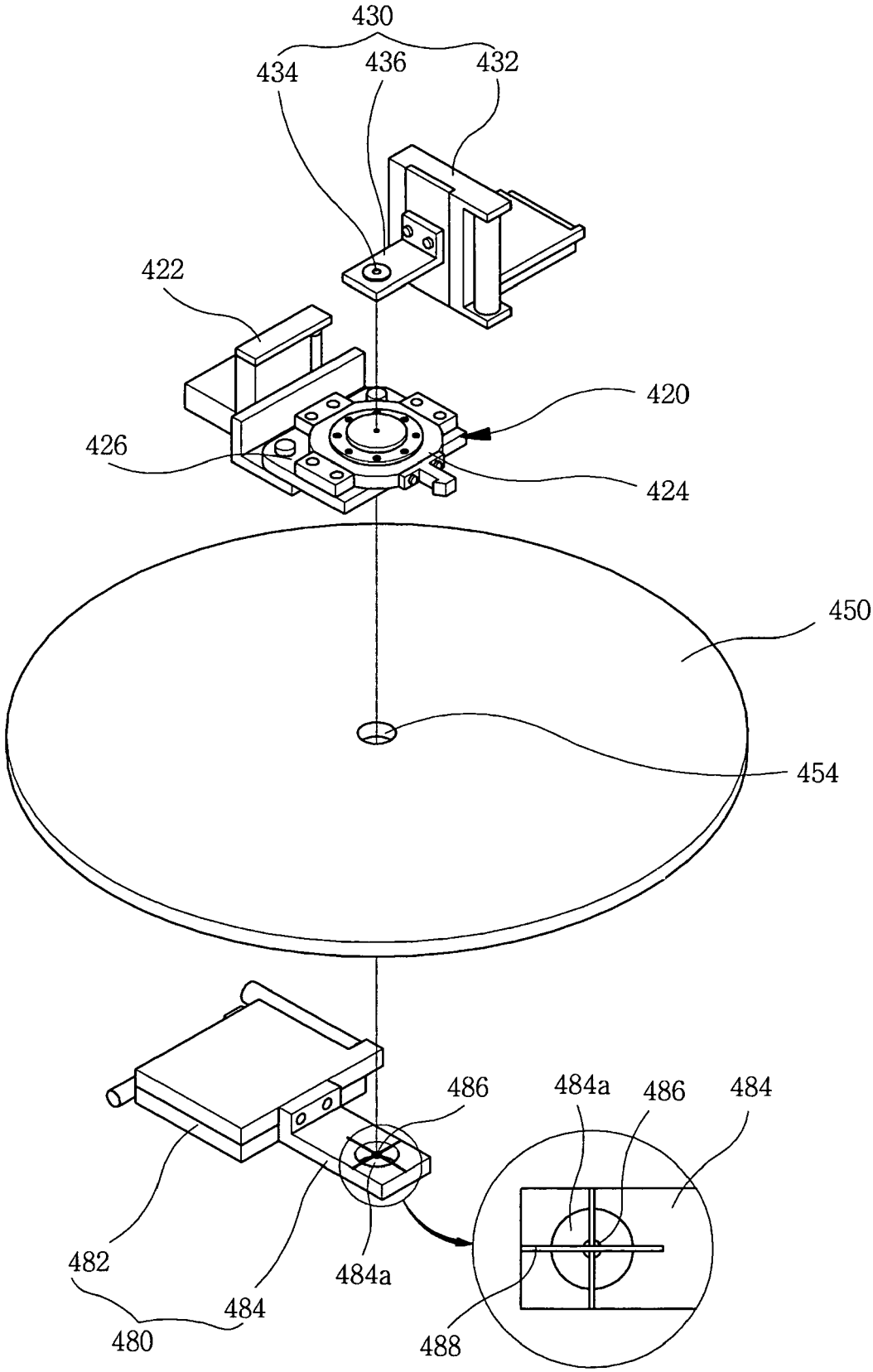
FIG. 7 is an exploded perspective view of a second base plate, a holder, and a second mirror according to the present invention.

FIG. 7 is an exploded perspective view of the second base plate 450, the holder 420, and the second mirror 430 according to the present invention. The second base plate 450 has a second transmission hole 454 formed in the center thereof and a plurality of supporting rods 452 fixed to the lower side to support the lower side thereof. The supporting rods 452 maintain a predetermined distance between the second base plate 450 and the first base plate 440.

Additionally, on the lower side of the second base plate 450, that is, in the lower side where the second transmission hole 454 is formed, the shielding device is installed.

Here, the shielding device 480 includes a through-hole 484*a* formed in a supporting plate 484 supported by a fourth transporting device 482, and a focal point interrupting plate 486 installed in the center of the through-hole 484*a* to interrupt the direct light.

Preferably, the focal point interrupting plate 486 is positioned in the center of the through-hole 484*a*, and includes a plurality of fixing pins 488 such that the focal point interrupting plate 486 is fixed in the through-hole 484*a*.

Meanwhile, on the second base plate 450, the holder part 420 and the second mirror 430 are installed.

Figure 8:
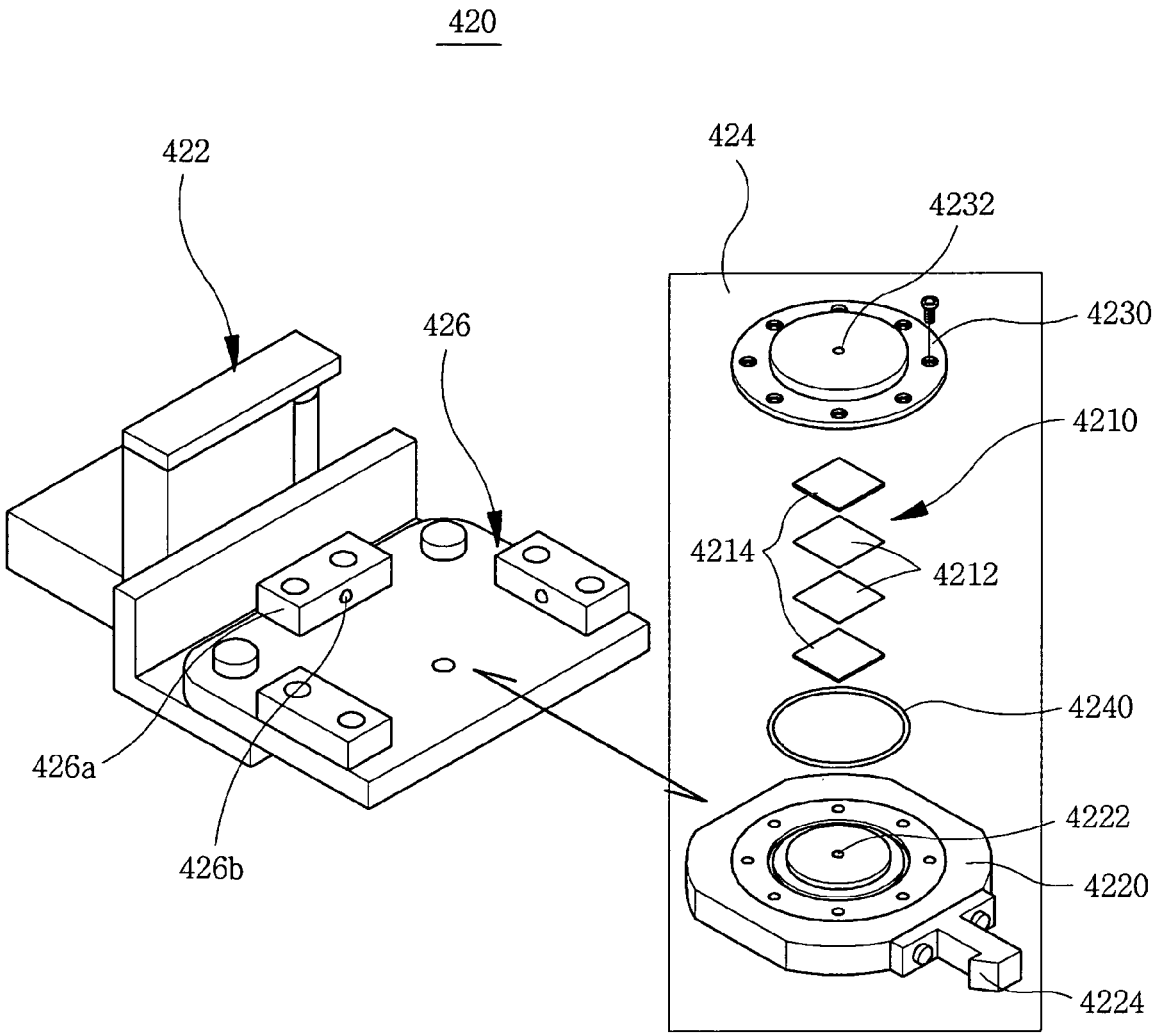
FIG. 8 is an exploded perspective view of the holder according to the present invention.

FIG. 8 is an exploded perspective view of the holder. The holder part 420 includes the second transporting device 422 installed on the upper side of the second base plate 450, a holder 424 for storing the living sample, and a coupling 426 installed on the second transporting device 422 to separate and couple the holder 424.

The holder 424 includes a sample part 4210 having sample windows 4212 made of a silicon nitride layer. ($Si_3N_4$) with a thickness of 90 nm to 120 nm to cover ends of the living sample and viton plates 4214 for covering ends of the sample windows 4212, a sample plate 4220, on which the sample part 4210 is placed, having a transmission hole 4222 formed in the center and a locking hook 4224 formed in a side, a cover plate 4230 for covering the upper side of the sample plate 4220 on which the sample part 4210 is placed and having a transmission hole 4232 formed in the center thereof, and an O-ring 4240 for maintaining sealing between the sample plate 4220 and the cover plate 4230. Thus, the holder 424 prevents moisture contained in the living sample from evaporating to protect the living sample.

The coupling 426 includes a plurality of supporting plates 426*a* having a plurality of ball plungers 426*b* to support an outer circumference of the sample plate 4220. Each of the supporting plates 426*a* has an opened portion where the ball plungers 426*b* do not interfere such that the holder 424 supported by the ball plungers 426*b* may be separated and coupled in one direction. The direction of the opened portion of the supporting plates 426*a* is preferably the axial direction where the holder 424 is transported by a rod lock chamber 70 described later.

Moreover, the second transporting device 422 is provided at the side of the coupling 426 and is preferably transported in the three directions of the X-axis, the Y-axis, and the Z-axis by a motor.

Figure 9:
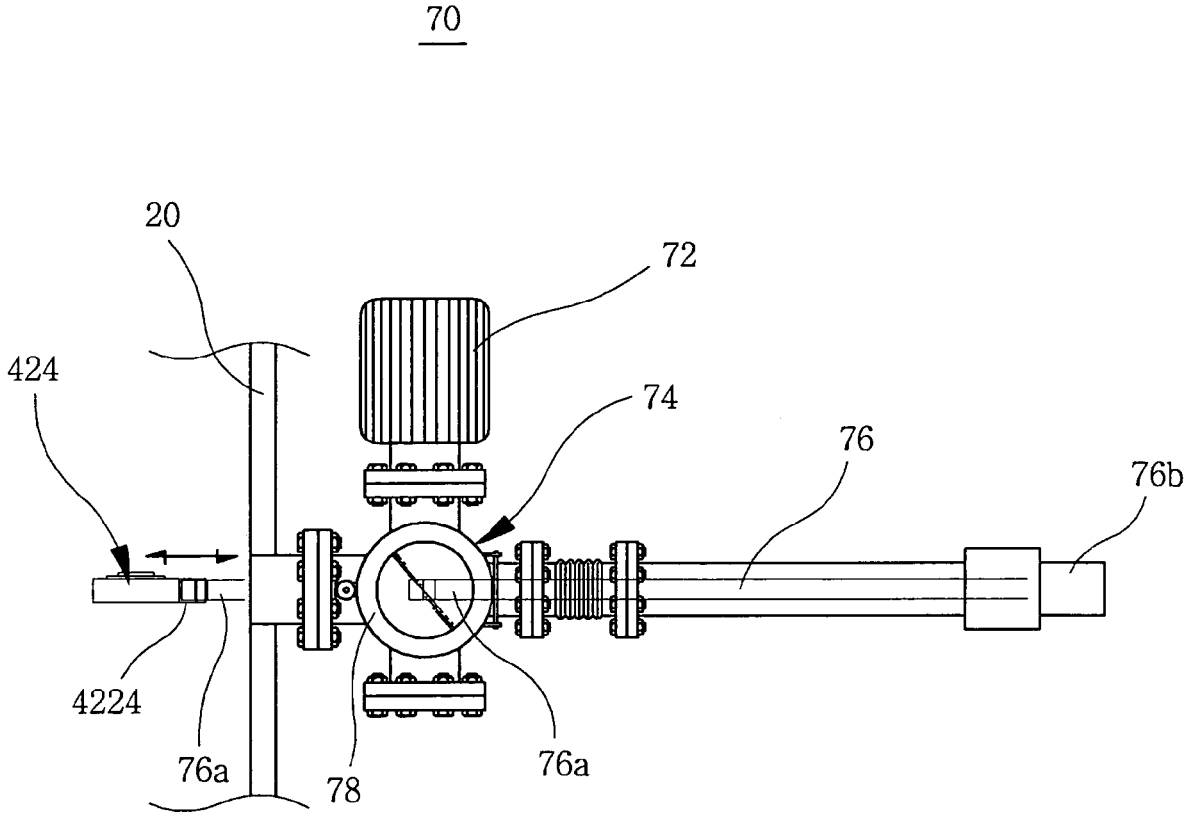
FIG. 9 is a side view of a rod lock chamber according to the present invention.

FIG. 9 is a side view of the rod lock chamber. The rod lock chamber 70 is provided at the side of the housing 20 and is structured to transport the holder part 420 such that vacuum of the mirror chamber 40 in the housing 20 is not damaged and the holder 424 storing the living sample is coupled with and separated from the coupling 426 of the holder part 420.

Additionally, the rod lock chamber 70 includes a vacuuming device 72 for preventing vacuum generated in the mirror chamber 40 from being damaged when the holder 424 storing the living sample is separated from and coupled with the mirror chamber 40. The vacuuming device 72 preferably includes a turbo molecular pump of 60 L/S and an ion pump of 30 L/S.

Here, the rod lock chamber 70 includes a chamber 74 fixed to a flange provided at the housing 20, a rod shaft 76 provided in the chamber 74 and moved forward and backward by a driving device 76*b*, and having a locking part 76*a*, formed in the side thereof, to which one side of the holder 424 is fixed, and the vacuuming device 72 provided at the side of the chamber 74 to vacuum the inside of the chamber 74 and to maintain vacuum of the chamber 74.

Particularly, since the chamber 74 has an opening and closing window 78 formed at the side thereof, the holder 424 can be coupled with or separated from the locking part 76*a* of the rod shaft 76 through the window 78. The window 78 has a transparent indicating window.

The second mirror 430 includes a third transporting device 432 installed on the second base plate 450, and a supporting plate 436 installed in the center of the third transporting device 432 and having a Fresnel diffraction zone plate 434 placed thereon to position above the holder 424.

Additionally, the Fresnel diffraction zone plate 434 is generally called as a zone plate, and is preferably manufactured by forming gold (Au) having a thickness of 100 nm to 160 nm on a silicon nitride layer ($Si_3N_4$) substrate. The Fresnel diffraction zone plate 434 has an outmost zone width of 30 mm to 40 mm and a diameter of 60 mm to 70 mm. Preferably, the number of Fresnel diffraction zone plate is 200 to 300.

The Fresnel diffraction zone plate 434 is installed to maintain the distance 0.8 mm from the living sample stored in the holder 424, and preferably, the distance between the Fresnel diffraction zone plate 434 and the image capturing chamber 50 is 800 mm. According to the optical magnification formula $$\frac{1}{a}+\frac{1}{b}=\frac{1}{f},$$

the optical magnification is changed according to the difference between the distance from the living sample to the Fresnel diffraction zone plate and the distance the Fresnel diffraction zone plate to the image capturing chamber. It can be understood that the magnification of 1000× can be obtained in the above case.

At the side of the mirror chamber 40, an optical aligning device 80 is further provided. The optical aligning device 80 checks whether the first mirror 410, the holder part 420, and the second mirror 430 are aligned in the optical axis direction, and automatically aligns them.

The optical aligning device 80 projects a visible light, and the projected visible light is refracted by an objective lens and is projected to the second mirror 430 positioned at the lower side, the holder part 420, and the first mirror 410. The visible light refracted by the second mirror 430, the holder part 420, and the first mirror 410 is inputted to the optical aligning device through the objective lens such that the optical aligning device 80 performs calculation and automatically aligns second mirror 430, the holder part 420, and the first mirror 410.

At the side of the optical aligning device 80, a CCD camera is installed to watch the light path of the visible light and the automatic aligning through an external screen.

Additionally, a vacuuming device 460 is installed in the housing 20 in which the mirror chamber 40 is installed. Preferably, the vacuuming device 460 includes at least one turbo molecular pump of 210 L/S and at least one ion pump of 120 L/S.

The image capturing chamber 50 includes a cover plate 540 fixed by a plurality of fastening devices to cover the upper side of the housing 20, a multi-channel plate 510 installed at the upper side of the cover plate 540, and a CCD 520.

The multi-channel plate 510 converts an optical image signal obtained through the light amplified by the second mirror 430 into an electric signal.

The CCD 520 amplifies the electric signal converted by the multi-channel plate 510 and the amplified electric signal is converted into a visible light by a fluorophor such that the converted visible light forms an image on the external screen through an optical lens.

In this case, preferably, a vacuum chamber 530 for maintaining the distance between the multi-channel plate 510 of the image capturing chamber 50 and the Fresnel diffraction zone plate 434 is provided.

The operation of the soft X-ray microscope structured as described above will be described.

Figure 10:
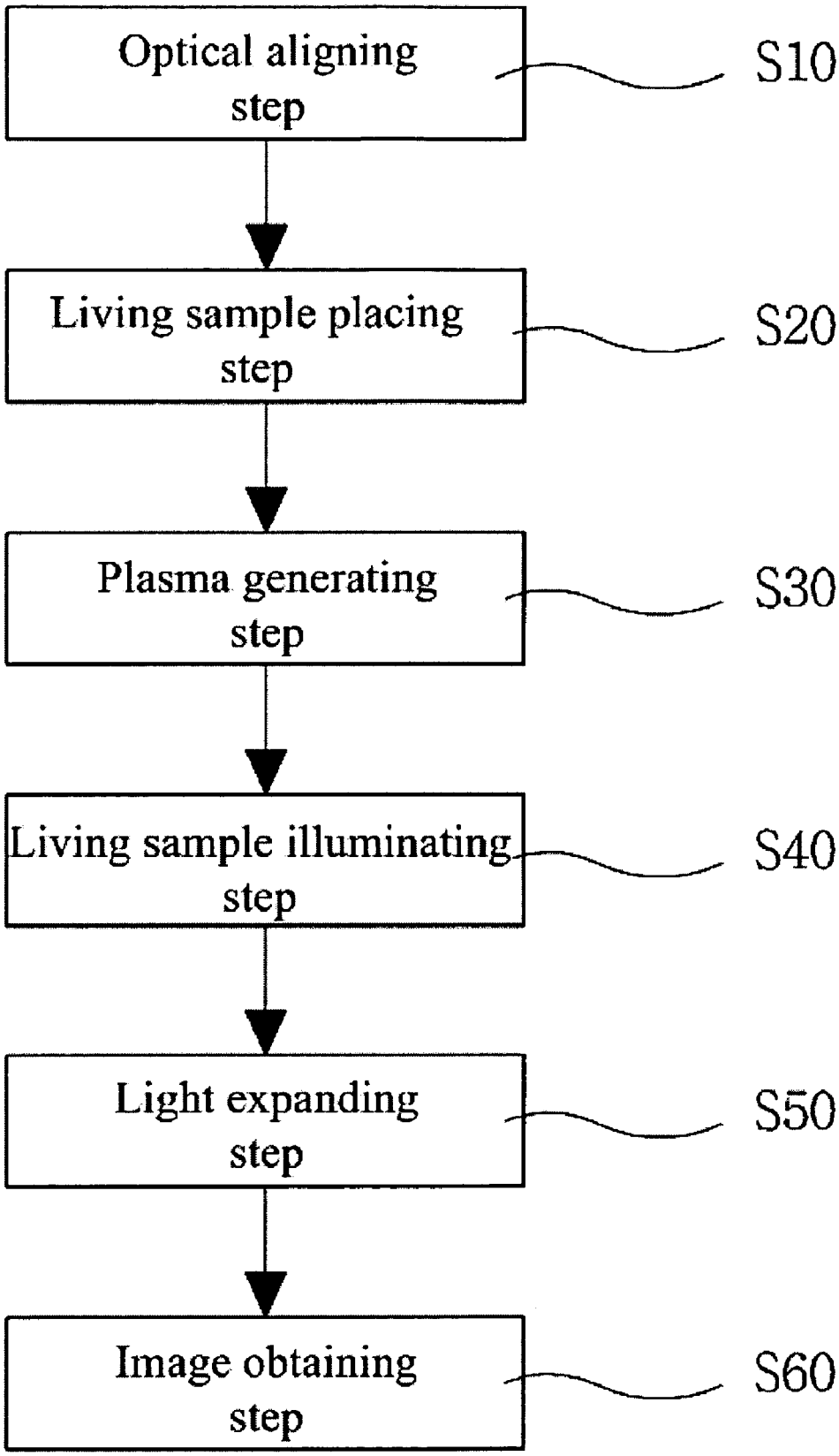
FIG. 10 is a flowchart of a soft X-ray microscope according to the present invention.

FIG. 10 is a flowchart of the soft X-ray microscope according to the present invention. Referring to the drawing, firstly, an optical aligning step S10 is a procedural step of checking whether the second mirror in the mirror chamber, the holder, and the first mirror are aligned in the optical axis direction and of automatically aligning the second mirror, the holder, and the first mirror if the second mirror, the holder, and the first mirror are not aligned yet. The optical aligning step S10 is carried out by the optical aligning device 80 installed at the side of the mirror chamber 40.

In other words, the visible light projected from the optical aligning device 80 is refracted downward through the objective lens, the refracted visible light passes through the Fresnel diffraction zone plate 434 of the second mirror 430, the holder 424 of the holder part 420 and the condenser mirror 414 of the first mirror 410 and the positions are measured. The measured positions are calculated, if necessary to compensate, a signal is transmitted to an integrally driving program so that the transporting devices installed in the respective devices automatically align the respective devices in the optical axis direction.

Of course, the automatic alignment can be watched from exterior through the CCD provided at the side of the optical aligning device 80.

A living sample placing step S20 is a procedural step of placing the living sample in the soft X-ray microscope, and is carried out by the rod lock chamber 70 provided at the side of the mirror chamber 40.

In this case, after positioning a predetermined sized living sample between a plurality of the sample windows 4212, the sample windows 4212 are stacked and the outer sides of the sample windows 4212 are covered by the viton plates 4214.

The sample part 4212 structured as such is positioned on the sample plate 4220 and the cover plate 4230 is fastened on the sample plate 4220.

At that time, the O-ring 4240 is provided between the sample plate 4220 and the cover plate 4230 so as to maintain sealing force so that evaporation of moisture contained in the living sample under vacuum is minimized.

The holder 424, in which the living sample is stored in the above procedures, opens the window 78 of the rod lock chamber 70 and locks and fixes the locking hook 4224 of the holder 424 to the end of the rod shaft 76.

After that, the opened window 78 is closed and the vacuuming device 72 of the rod lock chamber 70 performs vacuuming. This is to transport the holder 424 storing the living sample to the mirror chamber 40 without damaging vacuum of the housing 20 because the housing 20 including the light source chamber 30 maintains vacuum.

Although not depicted and described, a shielding layer is formed between the rod lock chamber 70 and the housing 20, due to the shielding layer, vacuum between the rod lock chamber 70 and the housing 20 is maintained, and additionally, the window 78 is automatically opened when transporting the holder 424 from the rod lock chamber 70 to the housing 20. This is general technique.

When finished the vacuuming of the rod lock chamber 70, the shielding layer is opened and the rod shaft 76 is advanced into the housing 20 by the driving device 76*a* such that the holder 424 is placed on the coupling 426 of the holder part 420 in the mirror chamber 40. The holder 424 is positioned inside the supporting plates 426*a* of the coupling 426 and is supported by the ball plungers 426*b* of the supporting plates 426*a*.

The rod shaft 76 transported the holder 424 is transported in the reverse direction by the driving device 76*a* and is positioned at the rod lock chamber 70.

When the holder 424 storing the living sample is placed in the mirror chamber 40, the soft X-ray microscope is operated to watch the living sample. According to circumstances, the alignment of the mirror chamber 40 can be checked again by the optical aligning device 80.

A plasma generating step S30 is a procedural step of generating plasma having a wavelength range of the soft X-ray by projecting a laser beam to the liquid target. In this step, nitrogen gas is jetted through the capillary tube 312 of the nozzle part 310 installed in the light source chamber 30 and the jetted nitrogen gas is liquefied due to liquid nitrogen filled in the outer tube 314 for surrounding the capillary tube 312 so that the liquid target is generated.

The light source 330 projects the high power laser to the liquid target so as to generate plasma having a wavelength of 2.3 nm to 4.4 nm of the soft X-ray by the light source 330.

Moreover, the liquid nitrogen jetted from the nozzle part 310 is suctioned into the discharge part 320 and discharged to the exterior so that the housing 20 including the light source chamber 30 can be prevented from being contaminated due to the liquid nitrogen and the continuous recycling is enabled.

As such, it can solve the problems that fine solid fragments are generated from a solid target projected by a laser beam when using the solid target and the fine solid fragments are suctioned into the light source chamber so that the suctioned fragments disturb the generation of the soft X-ray from the light source chamber, cause malfunction of the chamber, and restrict the continuous use of the chamber.

A living sample illuminating step S40 is a procedural step of amplifying the wavelength of the soft X-ray generated from the light source chamber and of illuminating the lower side of the living sample. In this step, the wavelength of the soft X-ray having an excellent monochromaticity is filtered through the liquid target of the light source chamber 30 by the filter 470 provided in the lower side of the first base plate 440, and a light penetrating the first transporting device 412 of the first base plate 440 is amplified by passing through the oval-shaped hedrons 414*a* and 414*b* of the condenser mirror 414 to illuminate the living sample.

Like the above description of the condenser mirror 414, the amplification of the wavelength of the soft X-ray by the condenser mirror 414 is carried out such that a light passing through one focal point P' is reflected by the oval-shaped hedron 414*a* and the reflected light passes through the central focal point P of the pin hole 414*c* and is reflected again by the oval-shaped hedron 414*b* positioned in the symmetric direction, so that the amplified light illuminates the living sample positioned at the another focal point P".

In this case, a light does not pass through the focal points P', P, and P" of the condenser mirror 414 is interrupted by the pin hole 414*c* or the shielding device 480 so that the living sample is prevented from being illuminated by the direct light generated from the light source chamber 30. By doing so, the illumination efficiency to the living sample by the condenser mirror 414 is enhanced.

A light expanding step S50 is a procedural step of amplifying and expanding a light illuminated to the living sample to obtain an image of the living sample from the image capturing chamber. In the step, the soft X-ray amplified by the condenser mirror 414 of the first mirror 410 illuminates the living sample, and the illuminated light is expanded to form an image on the multi-channel plate 510 of the image capturing chamber 50.

This is to amplify and expand a light using the Fresnel diffraction zone plate 434 of the second mirror 430. In other words, the light penetrated the living sample is diffracted by the 200 to 300 Fresnel diffraction zone plates of the Fresnel diffraction zone plate 434 and is collected to the focal distance.

In other words, the living sample and the Fresnel diffraction zone plate 434 maintains the distance of 0.8 mm and the Fresnel diffraction zone plate 434 and the image capturing chamber 50 maintain the distance of 800 mm so that an image of magnification of 1000× can be obtained in the image capturing chamber 50 through the light illuminated to the living sample.

An image obtaining step S60 is a procedural step of converting a light image expanded through the Fresnel diffraction zone plate into an electric signal to allow to watch the light image through an external screen or to print the light image. In this step, the light image is converted into the electric signal by the multi-channel plate 510 on which the light image amplified by maximum 1000× magnification through the Fresnel diffraction zone plate 434 of the second mirror 430 is collected.

The CCD 520 amplifies the converted electric signal and the amplified electric signal is converted into a visible light by the fluorophor such that the converted visible light forms an image on the external screen through an optical lens. Thus, the image of the living sample can be watched from exterior.

According to circumstances, the image of the living sample obtained through the CCD 520 is outputted on a monitor, in the form of a computer file, or printed on paper to allow watching the image.

As described above, the soft X-ray microscope according to the present invention uses a liquid target with no target pieces and having excellent monochromaticity ($\lambda/\Delta\lambda=1000$), has spatial resolution of no more than 100 nm, and can be continuously used for a long time.

Moreover, the soft X-ray microscope includes a mirror chamber made of a dual oval illuminating mirror and a Fresnel diffraction zone plate such that the living sample is illuminated by the illuminating mirror and the light penetrated the living sample is amplified and obtained by the Fresnel diffraction zone plate so that the resolution of no more than 100 nm and an expanded image more than 1000× magnification are provided, the distance from the mirror chamber to the image capturing device is minimized, and the microscope can be minimized.

Moreover, according to the soft X-ray microscope, the respective devices are vertically provided to minimize the installation space thereof so that it is possible to maximize the space efficiency, to increase the application range of the soft X-ray microscope, and to conveniently install the soft X-ray microscope.

Although the preferred embodiment of the soft X-ray microscope of the present invention has been described, it will be understood by those skilled in the art that the present invention should not be limited to the described preferred embodiment, but various changes and modifications can be made within the spirit and scope of the present invention as defined by the appended claims.

What is claimed is:

1. Soft X-ray microscope, comprising:

a table (10);

a housing (20) installed to the upper side of the table (10) and having a partition (22);

a light source chamber (30) installed lower than the partition (22) of the housing (20) to project a light to liquid jetted under a high pressure to generate plasma;

a mirror chamber (40), installed above the partition (22) of the housing (20), in which first and second mirror (410 and 430) are respectively installed to upper and lower sides of a holder (420) for storing a living sample, the soft X-ray generated by the plasma generated in the light source chamber (30) illuminates the living sample, and the soft X-ray penetrated the living sample is amplified to obtain an image in an image capturing chamber; and an image capturing chamber (50) installed to the upper side of the housing (20) to amplify a light image signal amplified through the mirror chamber (40) and to capture the light image on an external screen to allow distinguishing the light image from exterior;

wherein the mirror chamber (40) comprises:

a first base plate (440) fixed to the upper side of the partition (22) of the housing (20) and having a first transmission hole (442) formed in the central portion thereof;

a first mirror (410) including a first transporting device (412) installed on the first base plate (440), and a condenser mirror (414) installed in the central portion of the first transporting device (412) to amplify the light and to illuminate the living sample;

a second base plate (450) positioned above the first mirror (410), supported by a plurality of supporting rods (452) to maintain the distance from the first base plate (440), and having a second transmission hole (454) formed in the central portion thereof;

a holder part (420) including a second transporting device (422) installed on the second base plate (450), and a coupling (426) for separating and coupling the holder (424) storing the living sample from and to the central portion of the second transporting device (422);

a second mirror (430) including a third transporting device (432) installed on the second base plate (450), and a Fresnel diffraction zone plate (434) installed in the central portion of the third transporting device (432) and positioned above the holder (424); and a vacuuming device (460) for vacuuming the inside of the housing (20) having the mirror chamber (40) and for maintaining vacuum.

2. The soft X-ray microscope as claimed in claim 1, further comprising a telemicroscope (60) installed to the side of the light source chamber (30) to allow watching the procedure of projecting the soft X-ray to the high-pressure liquid to form the plasma from the exterior.

3. The soft X-ray microscope as claimed in claim 2, wherein, the light source chamber (30) comprises:

a nozzle part (310) for jetting liquid nitrogen supplied from the exterior under a high pressure;

a discharge part (320) provided opposite to the nozzle part (310) to suction the liquid nitrogen and to discharge the liquid nitrogen to the exterior;

a light source (330) for projecting a light to the liquid nitrogen jetted from the nozzle part (310) to form the plasma; and a light source vacuum pump (340) for vacuuming the inside of the housing (20) in which the light source (30) is installed and for maintaining vacuum of the housing (20).

4. The soft X-ray microscope as claimed in claim 1, wherein, the light source chamber (30) comprises:

a nozzle part (310) for jetting liquid nitrogen supplied from the exterior under a high pressure;

a discharge part (320) provided opposite to the nozzle part (310) to suction the liquid nitrogen and to discharge the liquid nitrogen to the exterior;

a light source (330) for projecting a light to the liquid nitrogen jetted from the nozzle part (310) to form the plasma; and a light source vacuum pump (340) for vacuuming the inside of the housing (20) in which the light source (30) is installed and for maintaining vacuum of the housing (20).

5. The soft X-ray microscope as claimed in claim 4, wherein the nozzle part (310) comprises:

a capillary tube (312) for receiving the high-pressure nitrogen gas from the exterior to jet the high-pressure nitrogen gas; and an outer tube (314) for surrounding the outer circumference of the capillary tube (312) and for receiving the high-pressure liquid nitrogen from the exterior to be filled up and to liquefy the high-pressure nitrogen gas jet through the capillary tube (312).

6. The soft X-ray microscope as claimed in claim 4, wherein the light source (330) comprises a diode pump solid laser having an average power of 12 W and a repetition rate of 300 Hz.

7. The soft X-ray microscope as claimed in claim 4, wherein the light source vacuum pump (340) comprises a turbo molecular pump having a vacuum degree of more than 500 L/S.

8. The soft X-ray microscope as claimed in claim 1, further comprising a rod lock chamber (70) provided at the side of the mirror chamber (40) and to transport the holder (424) such that vacuum of the mirror chamber (40) is not damaged and the holder (424) storing the living sample is coupled with and separated from the coupling (426) of the holder part (420).

9. The soft X-ray microscope as claimed in claim 8, wherein the rod lock chamber (70) comprises a vacuuming device (72) for preventing vacuum generated in the mirror chamber (40) from being damaged when the holder (424) storing the living sample is separated from and coupled with the mirror chamber (40), wherein the vacuuming device (72) comprises a turbo molecular pump of 60 L/S and an ion pump of 30 L/S.

10. The soft X-ray microscope as claimed in claim 1, further comprising an optical aligning device (80) for checking whether the first mirror (410), the holder part (420), and the second mirror (430) are aligned in the optical axis direction, and for aligning the same.

11. The soft X-ray microscope as claimed in claim 1, wherein the condenser mirror (414) includes first and second oval-shaped hedrons (414*a* and 414*b*) symmetrical to each other and having an optical axis-directional length 136 mm, an inner diameter of 50 mm, and a depth of 42 mm, and a pin hole (414) formed in the center portion in the longitudinal direction; and the first and second oval-shaped hedrons (414*a* and 414*b*) are formed by ovals having a longitudinal directional center as a focal point (P), a distance of 160 mm from the focal point (P) to another focal points (P' and P"), and symmetrical to each other with respect to the central focal point (P).

12. The soft X-ray microscope as claimed in claim 1, wherein the Fresnel diffraction zone plate (434) is manufactured by forming gold (Au) having a thickness of 100 nm to 160 nm on a silicon nitride layer (Si3N4) substrate, and has an outmost zone width of 30 mm to 40 mm a diameter of 60 mm to 70 mm, and the number of Fresnel diffraction zone plate is 200 to 300.

13. The soft X-ray microscope as claimed in claim 1, wherein the vacuuming device (460) comprises at least one turbo molecular pump of 210 L/S and at least one ion pump of 120 L/S.

14. The soft X-ray microscope as claimed in claim 1, further comprising a filter (470) installed in the lower side of the first base plate (440) to filter the light transmitted to the mirror chamber (40) through the plasma generated by the light source chamber (30) and to separate the vacuum of the light source chamber (30) and the mirror chamber (40), and made of titanium.

15. The soft X-ray microscope as claimed in claim 1, further comprising a shielding device (480) installed to the lower side of the second base plate (450) to interrupt a direct light, which is not amplified by the condenser mirror (414), to directly illuminate the living sample when illuminating the illuminated through the condenser mirror (414), and including a through-hole (484*a*) formed in a supporting plate (484) supported by a fourth transporting device (482), and a focal point interrupting plate (486) installed in the center of the through-hole (484*a*) to interrupt the direct light.

16. The soft X-ray microscope as claimed in claim 1, wherein the image capturing chamber (50) comprises:

a multi-channel plate (510) for converting a light image signal obtained through the light amplified by the second mirror (430) into an electric signal; and a CCD (520) for amplifying the electric signal converted by the multi-channel plate (510) and for converting the amplified electric signal into a visible light using a fluorophor such that the converted visible light forms an image on the external screen through an optical lens.

17. A soft X-ray microscope, comprising:

a table (10);

a housing (20) installed to the upper side of the table (10) and having a partition (22);

a light source chamber (30) installed lower than the partition (22) of the housing (20) to project a light to liquid jelled under a high pressure to generate plasma;

a mirror chamber (40), installed above the partition (22) of the housing (20), in which first and second mirror (410 and 430) are respectively installed to upper and lower sides of a holder (420) for storing a living sample, the soft X-ray generated by the plasma generated in the light source chamber (30) illuminates the living sample, and the soft X-ray penetrated the living sample is amplified to obtain an image in an image capturing chamber; and an image capturing chamber (50) installed to the upper side of the housing (20) to amplify a light image signal amplified through the mirror chamber (40) and to capture the light image on an external screen to allow distinguishing the light image from exterior;

wherein the holder part (420) comprises:

a holder (424) including:

a sample part (4210) having sample windows (4212) made of a silicon nitride layer (Si3N4) with a thickness of 90 nm to 120 nm to cover ends of the living sample and viton plates (4214) for covering ends of the sample windows (4212);

a sample plate (4220), on which the sample part (4210) is placed, haying a transmission hole (4222) formed in the center and a locking hook (4224) formed in a side;

a cover plate (4230) for covering the upper side of the sample plate (4220) on which the sample part (4210 ) is placed and having a transmission hole (4232) formed in the center thereof; and an O-ring (4240) for maintaining sealing between the sample plate (4220) and the cover plate (4230);

a coupling (426) including a plurality of supporting plates (426*a*) having a plurality of ball plungers (426*b*) to support outer circumference of the sample plate (4220), and an opened portion enabling the holder (424) to separate; and a second transporting device (422) provided at the side of the coupling (426) and transported in the three directions of the X-axis, the Y-axis, and the Z-axis by a motor.

18. A soft X-ray microscope, comprising:

a table;

a housing installed at an upper side of the table, and having a partition, the partition separating the housing into a mirror chamber disposed above the partition and a light source chamber disposed below the partition, the light source chamber projecting light to a liquid jetted under a high pressure to thereby generate plasma, a soft X-ray being generated from the plasma in the light source chamber, the mirror chamber having:

a first base plate fixed to an upper side of the partition and having a first transmission hole formed in a central portion thereof;

a first mirror including a first transporting device installed on the first base plate, and a condenser mirror installed at a central portion of the first transporting device, the condenser mirror amplifying the soft X-ray and illuminating and penetrating a living sample, to obtain an optical image signal;

a second base plate positioned above the first mirror, and being supported by a plurality of supporting rods to separate the second base plate from the first base plate, and having a second transmission hole formed in a central portion thereof;

a holder part for storing the living sample, the holder part having a second transporting device installed on the second base plate, and a coupling that respectively separates and couples a holder from and to the central portion of the second transporting device; and a second mirror disposed at an upper side of the holder, and including a third transporting device installed on the second base plate, and a Fresnel diffraction zone plate installed at a central portion of the third transporting device and positioned above the holder; and a vacuuming device for generating and maintaining a vacuum inside the mirror chamber; and an image capturing chamber installed at an upper side of the housing to amplify the optical image signal and to capture the optical image signal on an external screen to allow an image of the living sample to be viewed.

19. A soft X-ray microscope, comprising:

a table;

a housing installed at an upper side of the table, and having a partition, the partition separating the housing into a mirror chamber disposed above the partition and a light source chamber disposed below the partition, the light source chamber projecting light to a liquid jetted under a high pressure to thereby generate plasma, the mirror chamber having:

a holder part for storing a living sample, the holder part including:

a holder including:

a sample part having a plurality of sample windows, each being made of a silicon nitride layer (Si3N4) with a thickness of 90 nm to 120 nm, to cover the living sample, and a plurality of viton plates for covering the sample windows;

a sample plate, having an upper side on which the sample part is placed, a transmission hole formed in a center thereof, and a locking hook formed at a side thereof;

a cover plate for covering the upper side of the sample plate, and having a transmission hole formed in a center thereof; and an O-ring for maintaining a seal between the sample plate and the cover plate;

a coupling including a plurality of supporting plates, each having a ball plunger to support an outer circumference of the sample plate, and an opened portion enabling the holder to be separated therefrom; and a second transporting device provided at a side of the coupling and being movable along an X-axis, a Y-axis, and a Z-axis by a motor; and a first mirror disposed at a lower side of the holder, and a second mirror disposed at an upper side of the holder, a soft X-ray being generated from the plasma in the light source chamber, the soft X-ray being amplified by the first mirror and illuminating and penetrating the living sample, to obtain an optical image signal; and an image capturing chamber installed at an upper side of the housing to amplify the optical image signal and to capture the optical image signal on an external screen to allow an image of the living sample to be viewed.

* * * * *